US009423741B1

(12) United States Patent
Kimura

(10) Patent No.: US 9,423,741 B1
(45) Date of Patent: Aug. 23, 2016

(54) FIXING PRESS MEMBER, FIXING DEVICE, AND IMAGE FORMING APPARATUS

(71) Applicant: FUJI XEROX CO., LTD., Tokyo (JP)

(72) Inventor: Jun Kimura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/810,555

(22) Filed: Jul. 28, 2015

(30) Foreign Application Priority Data

Mar. 26, 2015 (JP) ..... 2015-064142

(51) Int. Cl.
*G03G 15/20* (2006.01)

(52) U.S. Cl.
CPC ..... *G03G 15/2089* (2013.01); *G03G 15/2053* (2013.01); *G03G 15/2057* (2013.01); *G03G 15/2064* (2013.01); *G03G 2215/2048* (2013.01)

(58) Field of Classification Search
CPC ..... G03G 15/20
USPC ..... 399/333
See application file for complete search history.

(56) References Cited

U.S. PATENT DOCUMENTS 4,796,046 A * 1/1989 Suzuki ..... G03G 15/2057 219/216
8,005,413 B2 * 8/2011 Sakakibara ..... G03G 15/206 399/331
2002/0034409 A1 * 3/2002 Furuya ..... G03G 15/2057 399/333
2003/0156867 A1 * 8/2003 Finn ..... G03G 15/2057 399/333
2010/0310290 A1 * 12/2010 Sugawara ..... F16C 13/00 399/333
2011/0091252 A1 * 4/2011 Sekihara ..... G03G 15/206 399/333
2011/0206428 A1 * 8/2011 Fujihara ..... G03G 15/2057 399/333
2012/0014726 A1 * 1/2012 Sekihara ..... G03G 15/206 399/333
2014/0255067 A1 * 9/2014 Matsunaka ..... G03G 15/2057 399/333
2014/0301763 A1 * 10/2014 Miura ..... G03G 15/2057 399/333
2015/0030363 A1 * 1/2015 Sugawara ..... G03G 15/2057 399/333
2015/0071690 A1 * 3/2015 Miyahara ..... G03G 15/206 399/333
2015/0160596 A1 * 6/2015 Asaka ..... G03G 15/2089 399/333

FOREIGN PATENT DOCUMENTS

JP 2002-006662 A 1/2002
JP 2009-103882 * 5/2009 ..... G03G 15/00
JP 2009-103882 A 5/2009

* cited by examiner

*Primary Examiner* — Clayton E Laballe
*Assistant Examiner* — Kevin Butler
(74) *Attorney, Agent, or Firm* — Sughrue Mion, PLLC

(57) ABSTRACT

A fixing press member includes a substantially tubular thermal conductive layer containing a resin and a substantially scale-shaped filler having a higher thermal conductivity than the resin, and a surface layer disposed on an outer circumferential surface side of the thermal conductive layer.

11 Claims, 7 Drawing Sheets

FIXING PRESS MEMBER, FIXING DEVICE, AND IMAGE FORMING APPARATUS

CROSS-REFERENCE TO RELATED APPLICATIONS

This application is based on and claims priority under 35 USC 119 from Japanese Patent Application No. 2015-064142 filed Mar. 26, 2015.

BACKGROUND (i) Technical Field

The present invention relates to a fixing press member, a fixing device, and an image forming apparatus.

(ii) Related Art

In image forming apparatuses using electrophotographic systems such as copying machines and printers, unfixed toner images formed on recording media such as recording paper sheets are fixed with fixing devices.

Such a fixing device has, for example, a configuration including a heating roller and a press belt disposed so as to be in contact with the heating roller, or a configuration including a heating belt and a press roller disposed so as to be in contact with the heating belt.

SUMMARY

According to an aspect of the invention, there is provided a fixing press member including a tubular or substantially tubular thermal conductive layer containing a resin and a scale-shaped or substantially scale-shaped filler having a higher thermal conductivity than the resin, and a surface layer disposed on an outer circumferential surface side of the thermal conductive layer.

BRIEF DESCRIPTION OF THE DRAWINGS

Exemplary embodiments of the present invention will be described in detail based on the following figures, wherein.

DETAILED DESCRIPTION

Figure 1:
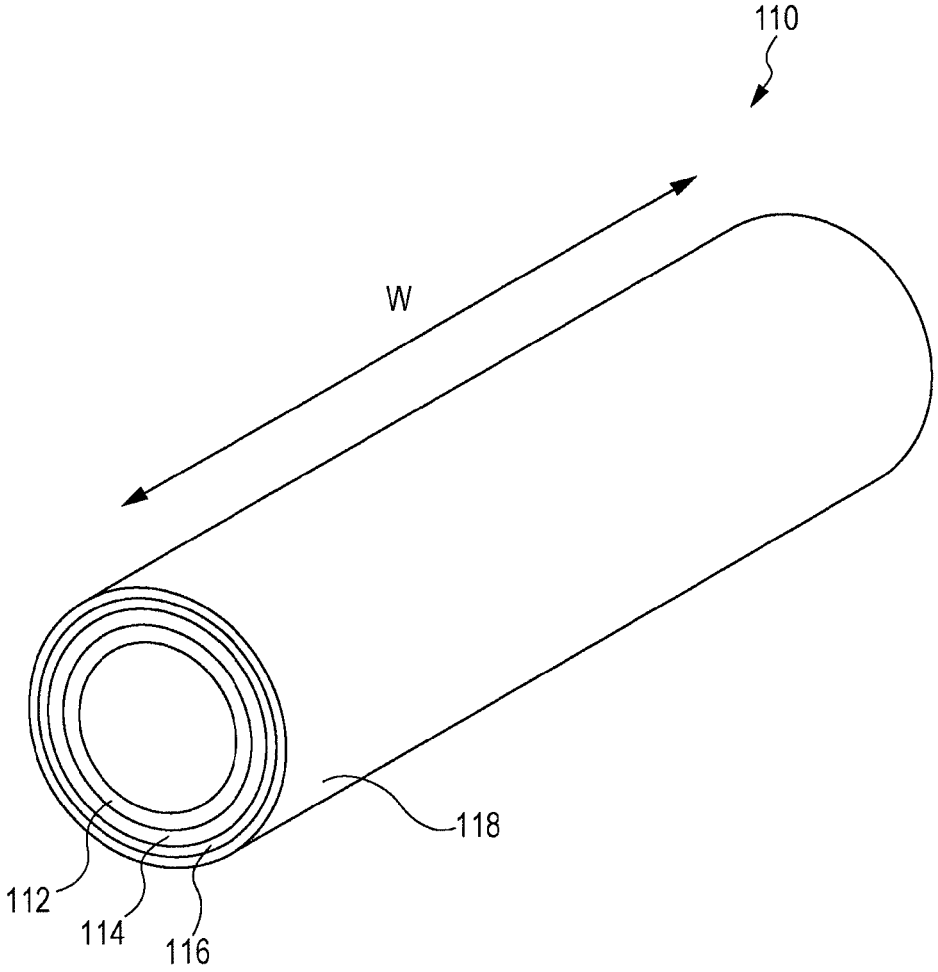
FIG. 1 is a schematic perspective view illustrating an example of a press member according to an exemplary embodiment.

Hereinafter, exemplary embodiments serving as examples of the present invention will be described.

Members that have substantially the same functions may be denoted by the same reference numerals through all drawings and repetitive reference numerals and explanations of such members may be omitted.

Fixing Press Member

A fixing press member (hereafter sometimes referred to as a "press member") according to an exemplary embodiment will be described. A press member according to an exemplary embodiment includes a tubular or substantially tubular thermal conductive layer containing a resin and a scale-shaped or substantially scale-shaped filler having a higher thermal conductivity than the resin and a surface layer disposed on an outer circumferential surface side of the thermal conductive layer.

Figure 2:
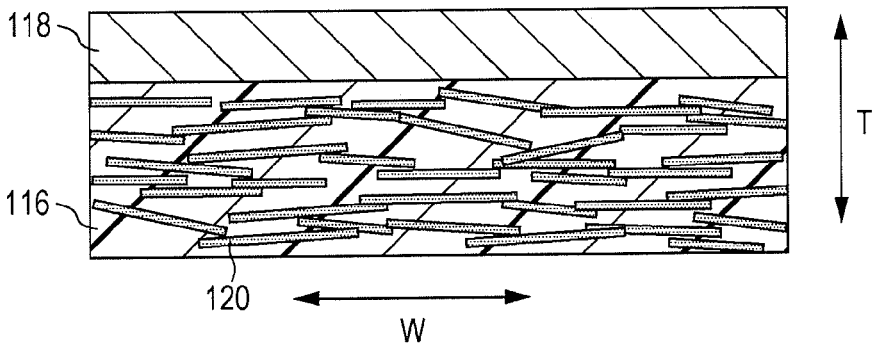
FIG. 2 is a schematic view illustrating an example of a scale-shaped filler arrangement in a section of a thermal conductive layer in the thickness direction.
Figure 3:
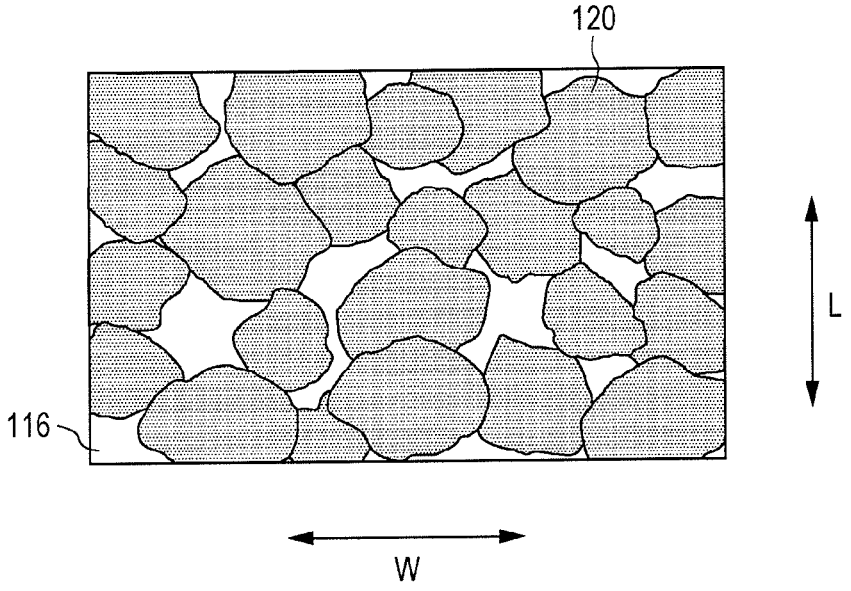
FIG. 3 is a schematic view illustrating an example of a scale-shaped filler arrangement in the in-plane direction of a thermal conductive layer.

FIG. 1 is a schematic perspective view illustrating an example of a press member according to an exemplary embodiment. The press member in FIG. 1 is a press member having a roller shape (hereafter sometimes referred to as a "press roller") and has a structure in which, on a tubular base member 112, an elastic layer 114, a thermal conductive layer 116, and a surface layer 118 are stacked in this order. FIG. 2 is a schematic view illustrating an example of a scale-shaped filler arrangement in a section of the thermal conductive layer 116 in the thickness direction. FIG. 3 is a schematic view illustrating an example of a scale-shaped filler arrangement in the in-plane direction of the thermal conductive layer 116.

A press member according to an exemplary embodiment allows suppression of an increase in a temperature difference in the width direction of the press member during repeated fixing of images. The reason for this is probably as follows.

In general, during formation of a toner image on a recording medium in an image forming apparatus, an unfixed toner image formed on a recording medium is transported to the nip between a heating member and a press member in a fixing device, and the heating member melts and presses the toner to thereby fix the image. In such an image forming apparatus, repeated image formation on paper sheets having the same width causes a temperature difference, in the fixing members (heating member and press member), between a paper-passing region (where the paper sheets pass) and a non-paper-passing region (where no paper sheets pass) outside the paper-passing region. After such repeated printing on paper sheets having a small width, for example, printing on paper sheets having a large width tends to result in fixing unevenness of the toner. For this reason, the latter printing is performed after waiting time, that is, after the temperature of the fixing members becomes nearly uniform in the width direction (axial direction).

In addition, the press member thermally expands, resulting in deformation from the original shape. For this reason, from the standpoint of transport of paper sheets, after repeated printing on large paper sheets, printing on small paper sheets is performed after waiting time, that is, after the temperature of the heating belt becomes nearly uniform in the width direction (axial direction).

In contrast, a press member 110 according to an exemplary embodiment allows a decrease in the temperature difference between the paper-passing region and the non-paper-passing region. Specifically, the press member 110 includes a thermal conductive layer 116 containing a resin and a scale-shaped filler, on the inner side of a surface layer 118. Referring to FIGS. 2 and 3, pieces of the scale-shaped filler 120 contained in the thermal conductive layer 116 are dispersed in the resin so as to overlap one another in the thickness direction T and form layers (have the shape of layers). Thus, pieces of the scale-shaped filler are positioned close to one another in the in-plane direction, so that the thermal conductive layer 116 has a higher thermal conductivity in the in-plane direction than in the thickness direction T. As a result, heat conduction in the press member 110 tends to occur in the width direction W and in the circumferential direction L. This allows a decrease in the temperature difference between the paper-passing region and the non-paper-passing region. Also, the thermal conductive layer 116, which contains resin, is so flexible that the press member 110 is able to deform in a contact region where a recording medium is nipped between the press member 110 and the heating member.

With a demand for energy conservation, fixing devices including heating members having low heat capacity have come to be increasingly employed. A press member that is disposed so as to face such a heating member desirably insulates heat from the heating member. Accordingly, the press member is commonly formed so as to have an elastic layer formed of heat-insulating material such as a porous material. Use of such a press member including an elastic layer formed of a porous material tends to cause a further increase in the temperature difference between the non-paper-passing region and the paper-passing region from which recording media such as paper sheets take away heat.

In order to fix a toner image on a recording medium, the heating member and the press member apply heat and pressure to the contact region therebetween. In a case where the elastic layer is formed of a porous material having a higher porosity in order to enhance the heat-insulating property, the hardness of the elastic layer decreases. In this case, it is difficult to achieve both of the enhanced heat-insulating property and a sufficiently high contact pressure.

In contrast, a press member according to an exemplary embodiment allows high heat conduction in the width direction. Accordingly, even when the press member includes an elastic layer having a high porosity in order to enhance the heat-insulating property, the press member can still be formed so as to have a sufficiently high surface hardness for fixing toner images.

Hereinafter, a press roller and a press belt will be described as press members according to exemplary embodiments.

Press Roller

Referring to FIG. 1, a press roller 110 according to an exemplary embodiment has a structure in which, on a tubular base member 112, an elastic layer 114, a thermal conductive layer 116, and a surface layer 118 are stacked in this order.

Base Member

The base member 112 in the press roller 110 is, for example, a cylindrical body formed of a metal (such as aluminum, SUS, iron, or copper), alloy, ceramic, FRM (fiber reinforced metal), or the like.

The base member 112 may have an outer diameter of 10 mm or more and 50 mm or less, for example. The base member 112 that is formed of aluminum may have a thickness of 0.5 mm or more and 4 mm or less, for example. The base member 112 formed of SUS (stainless steel) or iron may have a thickness of 0.1 mm or more and 2 mm or less, for example.

Elastic Layer

The elastic layer 114 is formed so as to contain a heat-resistant elastic material. In this Specification, the term "heat-resistant" means that the material is not melted or decomposed even at a heating temperature (such as a fixing temperature) of a fixing device.

Examples of the heat-resistant elastic material include silicone rubbers and fluorocarbon rubbers.

Examples of the silicone rubbers include RTV silicone rubbers, HTV silicone rubbers, and liquid silicone rubbers: specifically examples include polydimethyl silicone rubber (MQ), methyl vinyl silicone rubber (VMQ), methyl phenyl silicone rubber (PMQ), and fluorosilicone rubber (FVMQ).

Examples of the fluorocarbon rubbers include vinylidene fluoride rubbers, tetrafluoroethylene/propylene rubbers, tetrafluoroethylene/perfluoromethyl vinyl ether rubber, phosphazene rubbers, and fluoropolyether.

The elastic layer 114 may have a cellular structure from the standpoint of enhancing the heat-insulating property. The cellular structure of the elastic layer 114 may be closed-cell structure or an open-cell structure.

The elastic layer 114 may contain various additives. Examples of the additives include reinforcing agents (such as carbon black), fillers (such as calcium carbonate), softening agents (such as paraffin agents), processing aids (such as stearic acid), age resisters (such as amines), vulcanizing agents (such as sulfur, metal oxides, or peroxides), and functional fillers (such as alumina).

The elastic layer 114 may have a thickness of 30 μm or more and 600 μm or less, desirably 100 μm or more and 500 μm or less, for example.

Thermal Conductive Layer

The thermal conductive layer 116 includes a resin and a scale-shaped filler having a higher thermal conductivity than the resin.

Examples of the resin for forming the thermal conductive layer include polyimide resins, polyamide resins, polyamide-imide resins, polyether ether ester resins, and polyarylate resins, and polyester resins.

The scale-shaped filler contained in the thermal conductive layer has a higher thermal conductivity than the resin contained in the thermal conductive layer.

In this Specification, the term "scale-shaped" means the shape of a thin piece such as a fish scale.

Figure 4A:
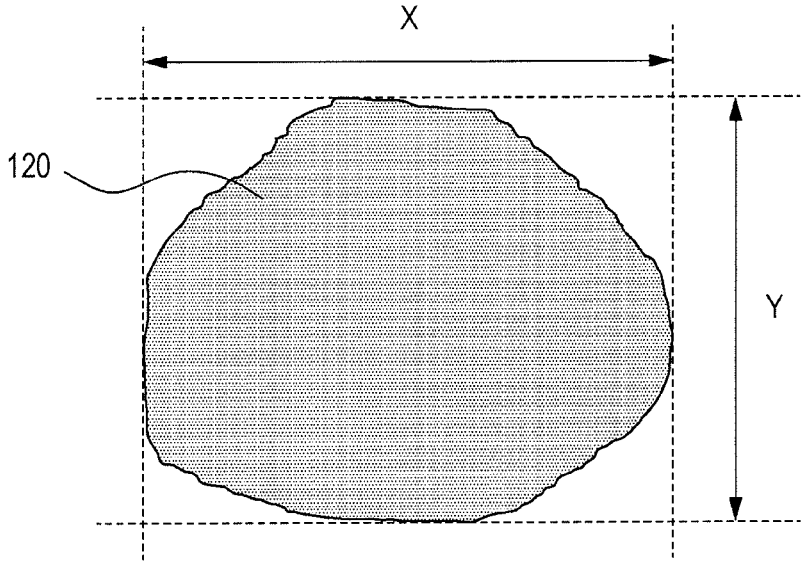
FIG. 4A is a schematic view illustrating an example of a scale-shaped filler viewed in the thickness direction.
Figure 4B:
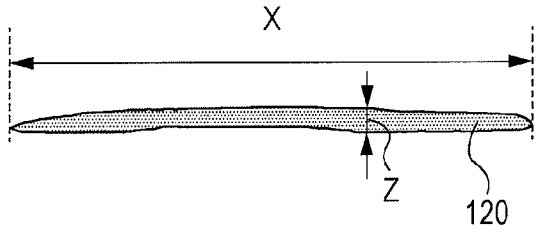
FIG. 4B is a schematic view of the scale-shaped filler viewed in a direction perpendicular to the thickness direction.

FIG. 4A is a schematic view illustrating an example of a scale-shaped filler (piece) according to an exemplary embodiment, viewed in the thickness direction. FIG. 4B is a schematic view of the scale-shaped filler viewed in a direction perpendicular to the thickness direction. The scale-shaped filler 120 according to an exemplary embodiment may satisfy the following conditions: referring to FIG. 4A, the scale-shaped filler 120 viewed in the thickness direction has a ratio X/Y of 1 or more and 5 or less where X represents the maximum length of the scale-shaped filler 120 and Y represents a length of the scale-shaped filler 120 in a direction perpendicular to the maximum length; referring to FIG. 4B, the scale-shaped filler 120 viewed in a direction perpendicular to the thickness direction has a ratio X/Z of 10 or more and 500 or less where X represents the maximum length and Z represents the maximum thickness of the scale-shaped filler 120.

Specifically, the scale-shaped filler 120 may have the following dimensions: when viewed in the thickness direction, the maximum length X and the length Y in a direction perpendicular to the maximum length are in the range of 3 μm or more and 10 μm or less; and the maximum thickness is in the range of 0.01 μm or more and 0.5 μm or less.

Specific examples of a material for forming the scale-shaped filler include graphite (natural graphite or synthetic graphite), boron nitride, metal flakes (such as aluminum flakes, copper flakes, or nickel flakes), nickel mica, and mica having been treated to be electrically conductive. From the standpoint of heat conduction and availability, the material may be graphite.

The content of the scale-shaped filler in the thermal conductive layer varies depending on, for example, the material or size of the scale-shaped filler or the manner in which the thermal conductive layer is formed. Regarding this content, from the standpoint of effectively decreasing the temperature difference in the in-plane direction (circumferential direction and width direction) of the heating roller and from the standpoint of ensuring a sufficiently high strength of the thermal conductive layer due to the resin, the content relative to the whole thermal conductive layer is preferably 5% by volume or more and 50% by volume or less, more preferably 10% by volume or more and 25% by volume or less.

The thermal conductive layer may contain, in addition to the resin and the scale-shaped filler, other components, if necessary. For example, a conductive powder other than the scale-shaped filler may be added and dispersed so as to control the volume resistivity of the thermal conductive layer. Specifically, for example, carbon black may be added and dispersed so as to control the volume resistivity of the thermal conductive layer.

Examples of other additives that may be added to the thermal conductive layer also include plasticizers and reinforcing fillers.

From the standpoint of ensuring high heat conduction, with the scale-shaped filler, in the in-plane direction (circumferential direction and width direction) of the heating roller, the thermal conductive layer 116 may have a thickness of, for example, 20 μm or more and 200 μm or less, desirably 30 μm or more and 150 μm or less, more desirably 40 μm or more and 100 μm or less.

The manner in which the thermal conductive layer is formed is not particularly limited. For example, a tubular member that is to serve as the thermal conductive layer may be formed in advance and the elastic layer may be covered with the tubular member. Alternatively, a thermal-conductive-layer coating solution for forming the thermal conductive layer may be applied to the elastic layer and dried to form the thermal conductive layer.

Specifically, the thermal conductive layer may be formed in the following manner, for example: a thermal-conductive-layer coating solution containing a resin, a scale-shaped filler, a solvent, and optionally other additives is prepared; while an article having an elastic layer on the surface of a cylindrical base member is rotated, the thermal-conductive-layer coating solution is applied to the elastic layer and dried to thereby form the thermal conductive layer. In this case, after the thermal-conductive-layer coating solution is applied to the elastic layer, some pieces of the scale-shaped filler may be oriented such that the longitudinal directions of the pieces are in or close to the thickness direction of the coating film. However, drying of the coating film results in formation of a thermal conductive layer in which the pieces of the scale-shaped filler are oriented such that the longitudinal directions of the pieces are in the in-plane direction of the thermal conductive layer as illustrated in FIG. 2.

Surface Layer

The surface layer 118 may contain a fluororesin. The surface layer 118 that contains a fluororesin exhibits a release property, which suppresses adhesion of toner and recording media to the surface layer 118.

Specific examples of the fluororesin contained in the surface layer 118 include tetrafluoroethylene/perfluoroalkyl vinyl ether copolymer (PFA), polytetrafluoroethylene (PTFE), tetrafluoroethylene/hexafluoropropylene copolymer (FEP), polyethylene/tetrafluoroethylene copolymer (ETFE), polyvinylidene fluoride (PVDF), polychlorotrifluoroethylene (PCTFE), and vinyl fluoride (PVF). From the standpoint of the release property, PTFE, PFA, and FEP are preferable; from the standpoint of moldability and heat resistance, PFA is particularly preferable.

The fluororesin content of the surface layer 118 is desirably 74% by mass or more, more desirably 80% by mass or more, from the standpoint of exhibiting the release property and suppressing cracking in the surface layer.

The surface layer 118 may contain, in addition to the fluororesin, for example, hollow particles for enhancing the heat-insulating property or electrically conductive particles (filler) such as carbon black for static control.

The surface layer 118 desirably has a thickness of, for example, 20 μm or more and 100 μm or less, more desirably 30 μm or more and 50 μm or less, from the standpoint of ensuring a sufficiently high mechanical strength and providing a low roller surface hardness for achieving a sufficiently large contact width between the surface layer 118 and the heating member.

A press roller according to the exemplary embodiment is not limited to the configuration in FIG. 1. For example, the press roller may have another layer such as an adhesive layer at least one of a position between the base member 112 and the elastic layer 114, a position between the elastic layer 114 and the thermal conductive layer 116, and a position between the thermal conductive layer 116 and the surface layer 118.

Press Belt

Figure 5:
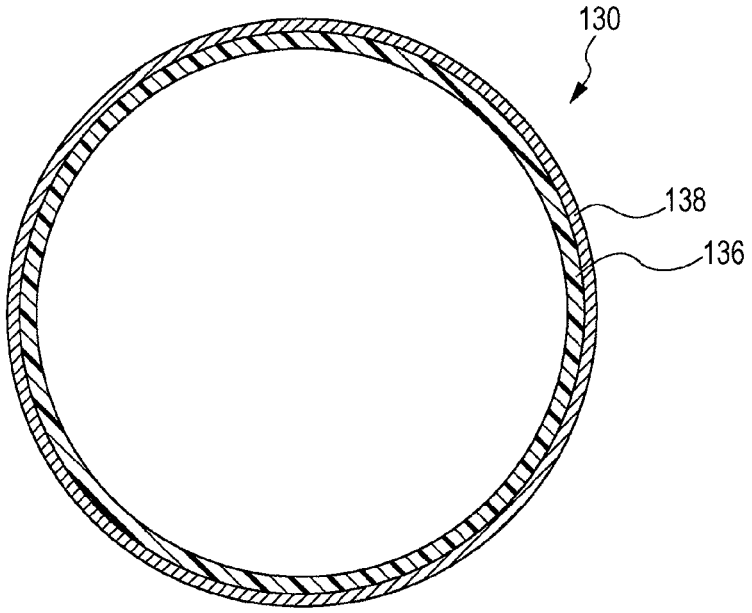
FIG. 5 is a schematic sectional view illustrating another example of the layer configuration of a press member according to an exemplary embodiment.

FIG. 5 illustrates another configuration of a press member according to the exemplary embodiment. The press member in FIG. 5 is a tubular (endless belt) press member (hereafter, sometimes referred to as a "press belt"). This press belt 130 according to the exemplary embodiment includes a tubular thermal conductive layer 136 and a surface layer 138 formed on the thermal conductive layer 136.

The thermal conductive layer 136 is formed of a resin and a scale-shaped filler having a higher thermal conductivity than the resin. Also, in the press belt 130 having this configuration, the scale-shaped filler is dispersed in the thermal conductive layer 136, so that heat conduction tends to occur in the width direction of the press belt 130, which allows suppression of an increase in a temperature difference in the width direction.

The configurations of the thermal conductive layer 136 and the surface layer 138 in the press belt 130 according to the exemplary embodiment are the same as the above-described configurations of the thermal conductive layer 116 and the surface layer 118 in the press roller 110. Accordingly, repetitive descriptions of the configurations are omitted.

A method for producing the press belt according to the exemplary embodiment is not particularly limited. For example, a thermal-conductive-layer coating solution prepared by adding a scale-shaped filler and optionally another additive to a PI (polyimide) precursor solution is applied to the surface of a cylindrical core body and is dried.

Subsequently, the surface of the dried coating film is coated with a surface-layer coating solution containing a fluororesin or the like and the solution is dried.

Subsequently, firing is carried out to produce an endless belt in which the thermal conductive layer 136 containing the scale-shaped filler oriented in the in-plane direction and the surface layer 138 are laminated.

A press belt according to the exemplary embodiment is not limited to the configuration in FIG. 5. For example, another layer such as an adhesive layer may be formed between the thermal conductive layer 136 and the surface layer 138. Another layer such as a base layer or an elastic layer may be formed on the inner side of the thermal conductive layer 136.

Fixing Device

A fixing press member according to an exemplary embodiment is used as a press member that is disposed so as to face a fixing heating member (hereafter sometimes referred to as a "heating member") in a fixing device in an image forming apparatus. Stated another way, a fixing device according to an exemplary embodiment includes a fixing heating member that is rotatably disposed and comes into contact with one of surfaces of a recording medium, the one surface having an unfixed toner image; a heating unit that heats the fixing heating member; and the fixing press member according to the exemplary embodiment, the fixing press member being rotatably disposed such that the recording medium is nipped between the fixing press member and the fixing heating member and the fixing press member comes into contact with another one of the surfaces of the recording medium.

The heating member may be a heating roller or a heating belt. The press member may be a press roller or a press belt. One of these press members and one of these heating members are combined to provide the fixing device. Specific examples of the fixing device according to an exemplary embodiment relate to a combination between a heating roller and a press roller; a combination between a heating roller and a press belt; a combination between a heating belt and a press roller; and a combination between a heating belt and a press belt.

Examples of the heating belt include a heating belt that performs heating using an external heat source and a heating belt that generates heat by electromagnetic induction.

Hereinafter, fixing devices according to first and second exemplary embodiments will be described; however, fixing devices according to exemplary embodiments are not limited to the following fixing devices.

Fixing Device According to First Exemplary Embodiment

Figure 6:
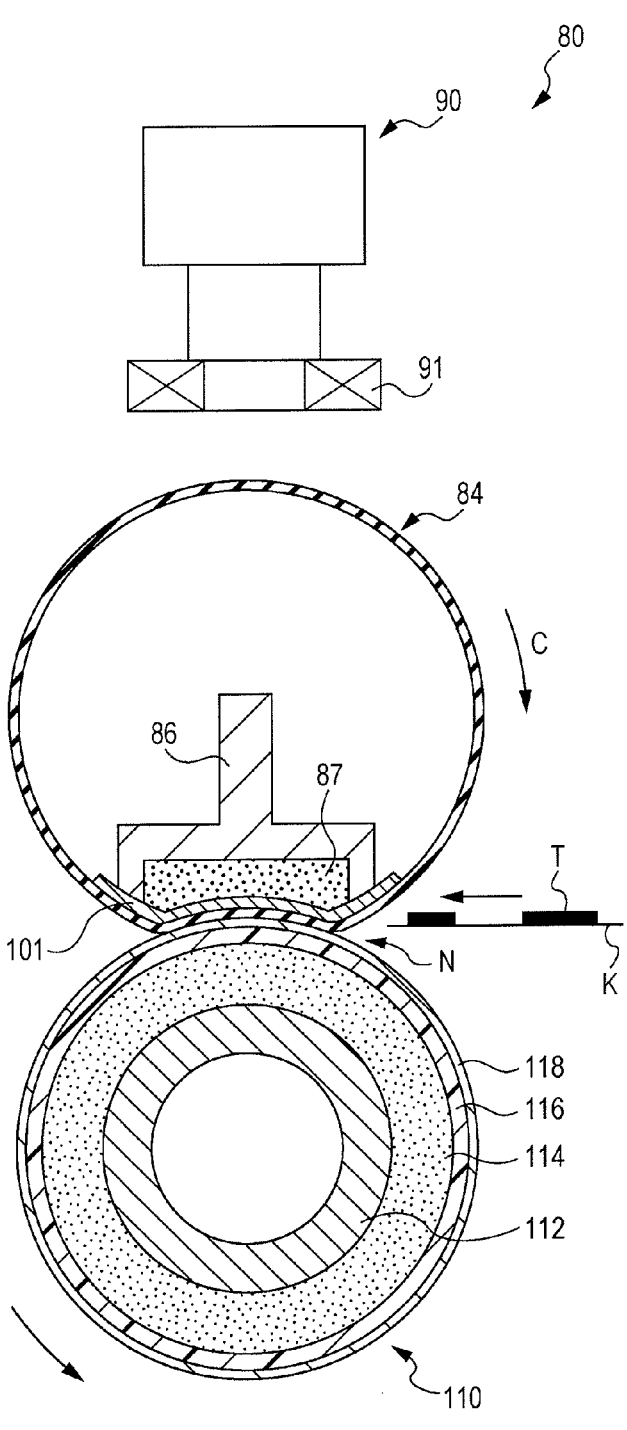
FIG. 6 is a schematic structural view illustrating an example of a fixing device according to an exemplary embodiment.

FIG. 6 is a schematic view illustrating the configuration of a fixing device 80 according to the first exemplary embodiment.

The fixing device 80 is an electromagnetic-induction-heating fixing device including a press roller 110 (an example of the press member) according to the above-described exemplary embodiment, a heating belt 84 (an example of the heating member), a press pad 87, a sliding member 101, and an electromagnetic induction device 90 (an example of the heating unit).

The press roller 110 is disposed so as to press the outer circumferential surface of the heating belt 84. Thus, a nip region N (nip part) is formed in a region where the press roller 110 and the heating belt 84 are in contact with each other.

The heating belt 84 includes, from the inner circumference to the outer circumference, for example, a base layer, a heat generation layer that generates heat by electromagnetic induction, an elastic layer, and a release layer in this order. The heating belt 84 is formed as an endless belt.

On the inner side of the heating belt 84, the press pad 87 is disposed so as to face the press roller 110. The press pad 87 is supported by a support member 86. The heating belt 84 is stretched on the press pad 87 and the press pad 87 presses the heating belt 84 to the press roller 110. The press pad 87 is a member formed of metal, heat-resistant resin, or heat-resistant rubber, for example.

A lubricant supply device (not shown) that supplies lubricant (oil) to the inner circumferential surface of the heating belt 84 may be disposed upstream of the press pad 87, for example.

The sliding member 101 is a sheet-shaped member. The sliding member 101 is disposed between the heating belt 84 and the press pad 87 such that the sliding surface is in contact with the inner circumferential surface of the heating belt 84 on which the sliding member 101 slides.

The electromagnetic induction device 90 is disposed so as to face the press roller 110 with the heating belt 84 therebetween. The electromagnetic induction device 90 generates heat by electromagnetic induction in the heat generation layer of the heating belt 84.

The electromagnetic induction device 90 contains an electromagnetic induction coil (excitation coil) 91. The electromagnetic induction device 90 applies alternating current to the electromagnetic induction coil 91 to generate a magnetic field. This magnetic field is changed with an excitation circuit to cause eddy current in the heat generation layer of the heating belt 84. This eddy current is converted to heat (Joule's heat) due to the electric resistance of the heat generation layer. Thus, heat is generated in the surface of the heating belt 84.

The heating belt 84 is rotated by a driving device (not shown) in a direction indicated by arrow C. This rotation drives the press roller 110 to rotate in a direction opposite to the rotation direction of the heating belt 84.

A paper sheet K (recording medium) having an unfixed toner image T is transported to the nip region N of the fixing device 80. When the paper sheet K passes through the nip region N, the toner image on the paper sheet K is fixed by pressure and heat applied in the nip region N.

Regarding the fixing device 80 according to the exemplary embodiment, the configuration in which the electromagnetic induction device 90 serves as an example of the heating unit is described. However, this configuration is not limitative. Other examples of the heating unit include halogen heaters (halogen lamps), radiant lamp heating elements (heating elements that emit radiation (such as infrared)) other than halogen heaters, and resistance heating elements (heating elements that generate Joule's heat by passing current through resistors: for example, a heating element produced by forming and firing a thick-film resistor on a ceramic substrate).

Fixing Device According to Second Exemplary Embodiment

Figure 7:
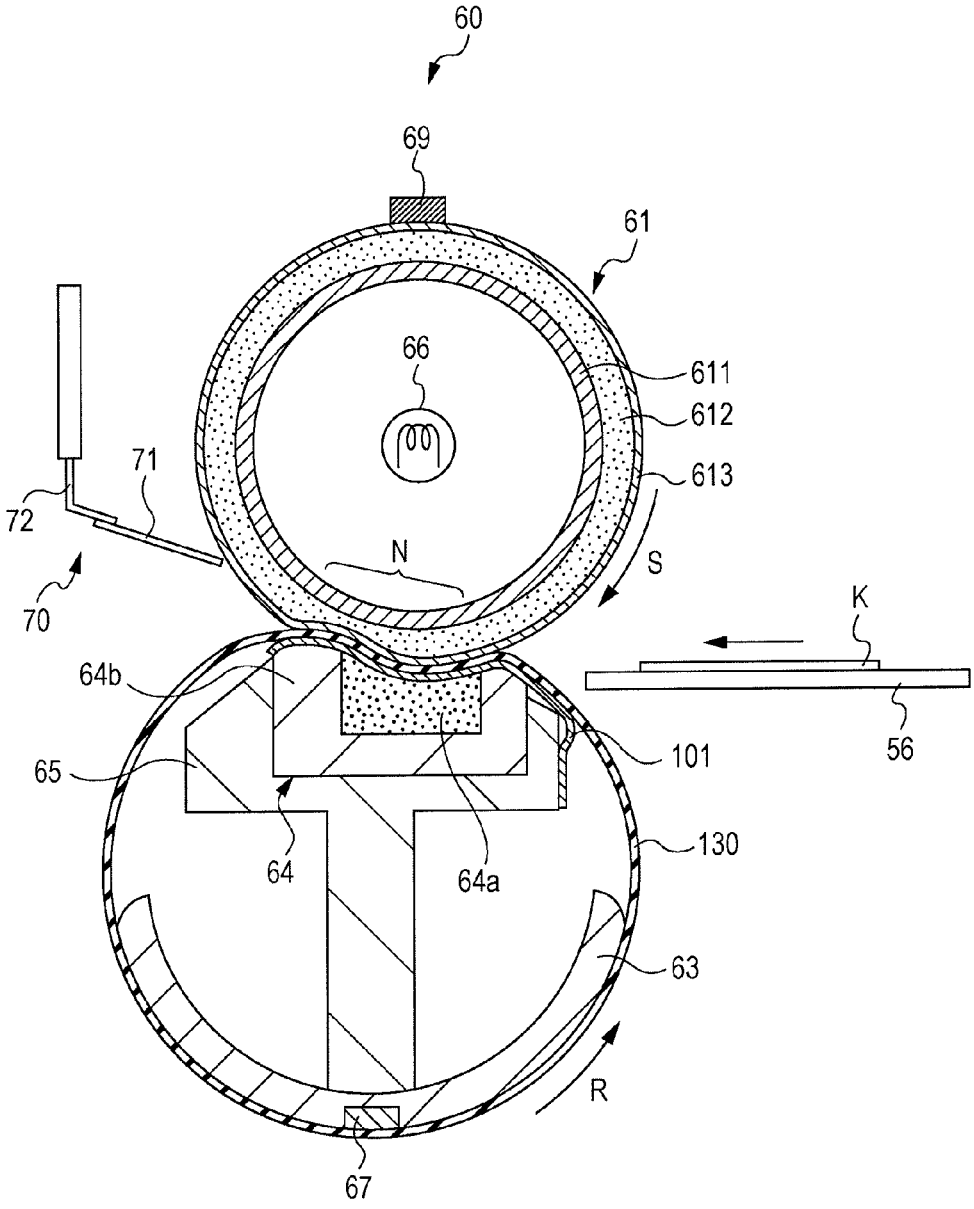
FIG. 7 is a schematic structural view of another example of a fixing device according to an exemplary embodiment.

FIG. 7 is a schematic view illustrating an example of a fixing device according to a second exemplary embodiment. A fixing device 60 according to this exemplary embodiment includes a heating roller 61 (an example of the heating member), which is a driving roller that rotates, a press belt 130 (an example of the press member) according to the above-described exemplary embodiment, and a press pad 64 that presses the heating roller 61 with the press belt 130 therebetween.

Regarding the press pad 64, for example, pressing is achieved between the press belt 130 and the heating roller 61. Specifically, the press belt 130 may be pressed by the heating roller 61, or the heating roller 61 may be pressed by the press belt 130.

The heating roller 61 contains a halogen lamp 66 (an example of the heating unit). The heating unit is not limited to the halogen lamp and may be another heating member that generates heat.

A temperature sensor 69 is disposed so as to be in contact with the surface of the heating roller 61, for example. Turning on/off of the halogen lamp 66 is controlled on the basis of the temperature values measured with the temperature sensor 69. In this way, the temperature of the surface of the heating roller 61 is maintained at a target temperature (for example, 150° C.)

In the heating roller 61, a heat-resistant elastic layer 612 and a release layer 613 are stacked in this order around a metal core (cylindrical metal core) 611, for example.

The press belt 130 is rotatably supported by a press pad 64 and a belt running guide 63 that are disposed on the inner side of the press belt 130, for example. The press belt 130 is disposed so as to be pressed, in the nip region N (nip part), to the heating roller 61 by the press pad 64.

The press pad 64 is disposed on the inner side of the press belt 130 so as to be pressed by the heating roller 61 via the press belt 130, for example. Thus, the press pad 64 and the heating roller 61 form the nip region N therebetween.

The press pad 64 includes, for example, an upstream nip member 64*a* that is used for providing a wide nip region N and disposed on the entry side of the nip region N, and a release nip member 64*b* that is used to distort the heating roller 61 and disposed on the exit side of the nip region N.

In order to decrease the sliding resistance between the inner circumferential surface of the press belt 130 and the press pad 64, for example, a sheet-shaped sliding member 101 is disposed on surfaces of the upstream nip member 64*a* and the release nip member 64*b*, the surfaces being in contact with the press belt 130. The press pad 64 and the sliding member 101 are held by a metal holding member 65.

The sliding member 101 is disposed such that, for example, the sliding surface is in contact with the inner circumferential surface of the press belt 130. The sliding member 101 contributes to holding and supplying of oil present between the sliding member 101 and the press belt 130.

The holding member 65 is provided with, for example, the belt running guide 63 such that the press belt 130 is rotated.

The heating roller 61 is, for example, rotated in a direction indicated by arrow S by a driving motor (not shown). This rotation drives the press belt 130 to rotate in a direction indicated by arrow R, opposite to the rotation direction of the heating roller 61. Specifically, for example, the heating roller 61 rotates clockwise in FIG. 7 whereas the press belt 130 rotates counterclockwise.

A paper sheet K (an example of the recording medium) having an unfixed toner image is guided with a fixing entry guide 56 and transported to the nip region N, for example. When the paper sheet K passes through the nip region N, the toner image on the paper sheet K is fixed by heat and pressure applied in the nip region N.

In the fixing device 60 according to this exemplary embodiment, for example, the upstream nip member 64*a* has a recessed shape conforming to the outer circumferential surface of the heating roller 61, so that a wide nip region N is provided, compared with a configuration not having the upstream nip member 64*a*.

In the fixing device 60 according to the exemplary embodiment, for example, the release nip member 64*b* is disposed so as to protrude toward the outer circumferential surface of the heating roller 61, so that the heating roller 61 has a large distortion at a position in the exit region of the nip region N.

The release nip member 64*b* is disposed in this way, so that, for example, the paper sheet K having been subjected to fixing and being passing through the release nip region passes the position of the large distortion. As a result, the paper sheet K is easily released from the heating roller 61.

As an auxiliary release unit, for example, a release member 70 is disposed downstream of the nip region N of the heating roller 61. For example, the release member 70 is held by a holding member 72 such that a release claw 71 is disposed in a direction (counter direction) opposite to the rotation direction of the heating roller 61 so as to be close to the heating roller 61.

In the fixing device 60 according to the exemplary embodiment, the configuration in which the halogen heater (halogen lamp) serves as an example of the heating source is described. However, this configuration is not limitative. Other examples of the heating source include radiant lamp heating elements (heating elements that emit radiation (such as infrared)) other than halogen heaters, and resistance heating elements (heating elements that generate Joule's heat by passing current through resistors: for example, a heating element produced by forming and firing a thick-film resistor on a ceramic substrate).

In a case where a heating belt is used as the heating member, a radiant lamp heating element may be used as the heating source. Alternatively, the heating belt may perform heating with a metal belt (or a metal layer constituting a portion of the metal belt) constituting a portion of the heating belt, the metal belt serving as a metal layer heated by electromagnetic induction.

Image Forming Apparatus

An image forming apparatus according to an exemplary embodiment includes an image carrier, a charging unit that charges the surface of the image carrier, a latent image forming unit that forms a latent image on the charged surface of the image carrier, a developing unit that develops the latent image with toner to form a toner image, a transfer unit that transfers the toner image onto a recording medium, and the fixing device according to one of the above-described exemplary embodiments that fixes the toner image on the recording medium.

Figure 8:
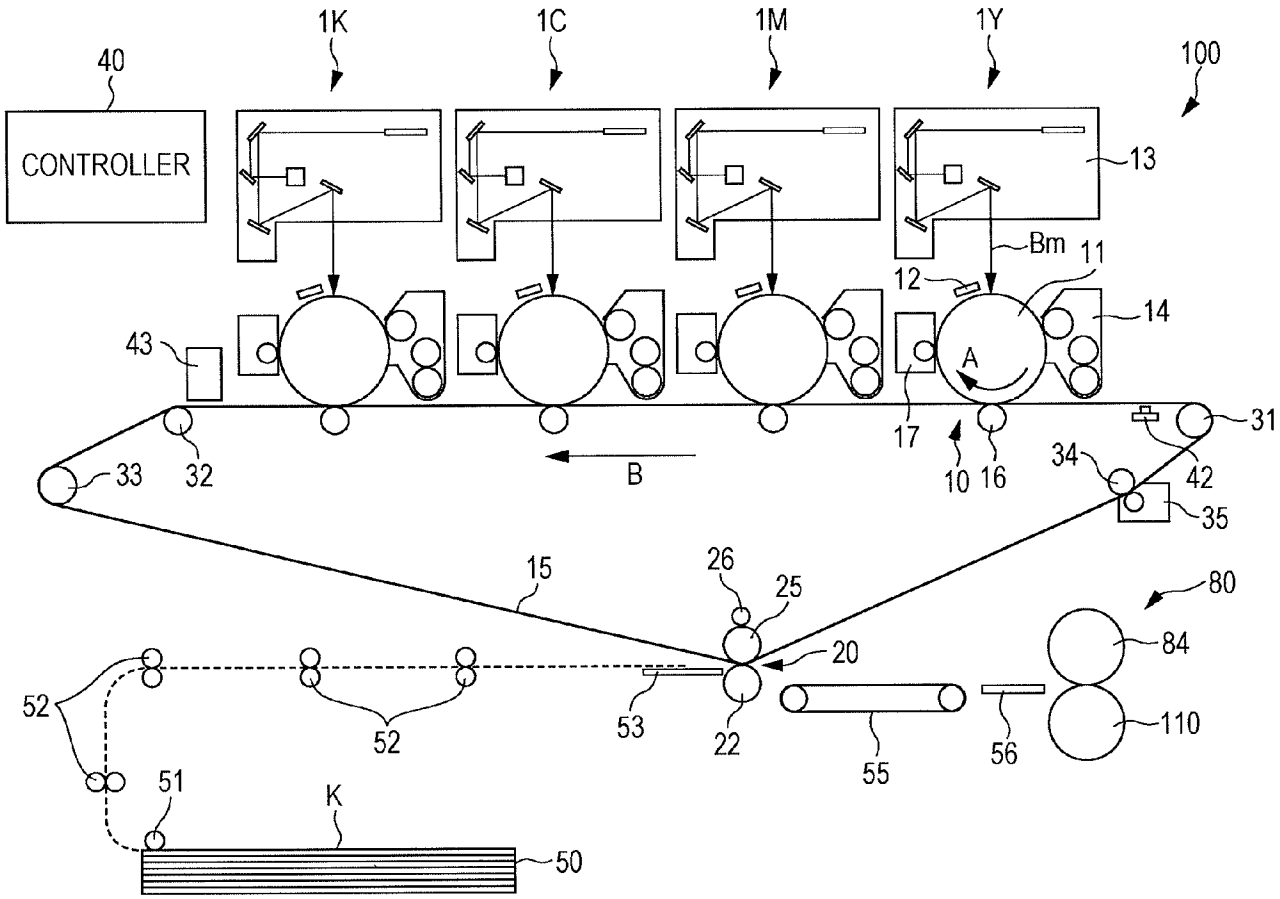
FIG. 8 is a schematic structural view illustrating an example of an image forming apparatus according to an exemplary embodiment.

FIG. 8 is a schematic view illustrating an example of the configuration of an image forming apparatus 100 according to an exemplary embodiment. The image forming apparatus 100 includes the fixing device 80 according to the above-described first exemplary embodiment. The image forming apparatus 100 may include, instead of the fixing device 80, the fixing device 60 according to the above-described second exemplary embodiment.

The image forming apparatus 100 is an intermediate-transfer image forming apparatus generally referred to as a tandem type. The image forming apparatus 100 includes image forming units 1Y, 1M, 1C, and 1K that individually form toner images of colors by an electrophotographic system; a first transfer part 10 that sequentially transfers (first transfer) the toner images of colors onto an intermediate transfer belt 15; a second transfer part 20 that collectively transfers (second transfer) the superposed toner images having been transferred onto the intermediate transfer belt 15, onto a paper sheet K, which is a recording medium; the fixing device 80 that fixes on the paper sheet K the images having been transferred by the second transfer; and a controller 40 that controls operations of units (parts).

Regarding the image forming units 1Y, 1M, 1C, and 1K, 1Y (unit for yellow), 1M (unit for magenta), 1C (unit for cyan), and 1K (unit for black) are arranged in this order substantially in line, from an upstream position to a downstream position of the intermediate transfer belt 15.

Each of the image forming units 1Y, 1M, 1C, and 1K includes a photoconductor 11 (an example of the image carrier). The photoconductor 11 is rotated in a direction indicated by arrow A.

The photoconductor 11 is surrounded by a charging device 12 (an example of the charging unit), a laser exposure device 13 (an example of the latent image forming unit), a developing device 14 (an example of the developing unit), a first transfer roller 16, and a photoconductor cleaner 17, that are sequentially disposed in the rotation direction of the photoconductor 11.

The charging device 12 charges the surface of the photoconductor 11.

The laser exposure device 13 emits an exposure beam Bm to form an electrostatic latent image on the photoconductor 11.

The developing device 14 contains a toner having one of the colors and turns the electrostatic latent image on the photoconductor 11 into a visible image with the toner.

The first transfer roller 16 transfers the toner image formed on the photoconductor 11 onto the intermediate transfer belt 15 in the first transfer part 10.

The photoconductor cleaner 17 removes remaining toner on the photoconductor 11.

The intermediate transfer belt 15 is formed of a material prepared by adding an antistatic agent such as carbon black to a resin such as polyimide or polyamide. The intermediate transfer belt 15 has, for example, a volume resistivity of $10^6$ Ωcm or more and $10^{14}$ Ωcm or less and a thickness of 0.1 mm.

The intermediate transfer belt 15 is supported by a driving roller 31, a support roller 32, a tension roller 33, a backup roller 25, and a cleaning backup roller 34. The intermediate transfer belt 15 is circulated (rotated) in a direction indicated by arrow B by rotation of the driving roller 31.

The driving roller 31 is driven by a motor (not shown) excellent in terms of operation at a constant speed to rotate the intermediate transfer belt 15.

The support roller 32 together with the driving roller 31 support the intermediate transfer belt 15, which extends substantially in line in the direction in which four photoconductors 11 are arranged.

The tension roller 33 applies a certain tension to the intermediate transfer belt 15 and also functions as a belt training roller that suppresses mistracking of the intermediate transfer belt 15.

The backup roller 25 is disposed in the second transfer part 20. The cleaning backup roller 34 is disposed in a cleaning part in which remaining toner on the intermediate transfer belt 15 is scraped off.

The first transfer roller 16 is disposed so as to be pressed onto the photoconductor 11 with the intermediate transfer belt 15 therebetween, to thereby form the first transfer part 10.

A voltage (first transfer bias) having a polarity opposite to the polarity (negative; hereafter this is the same) of the charged toner is applied to the first transfer roller 16. As a result, the toner images on the photoconductors 11 are sequentially adsorbed electrostatically onto the intermediate transfer belt 15. Thus, a superposed toner image is formed on the intermediate transfer belt 15.

The first transfer roller 16 is a cylindrical roller including a shaft (for example, a cylindrical rod formed of a metal such as iron or SUS) and an elastic layer (for example, a spongy layer formed of a rubber blend material containing a conductive agent such as carbon black) fixed around the shaft. The first transfer roller 16 has a volume resistivity of $10^{7.5}$ Ωcm or more and $10^{8.5}$ Ωcm or less, for example.

The second transfer roller 22 is disposed so as to be pressed onto the backup roller 25 with the intermediate transfer belt 15 therebetween, to thereby form the second transfer part 20.

A second transfer bias is generated between the second transfer roller 22 and the backup roller 25. As a result, the toner image is transferred (second transfer) onto the paper sheet K (recording medium) transported to the second transfer part 20.

The second transfer roller 22 is a cylindrical roller including a shaft (for example, a cylindrical rod formed of a metal such as iron or SUS) and an elastic layer (for example, a spongy layer formed of a rubber blend material containing a conductive agent such as carbon black) fixed around the shaft. The second transfer roller 22 has a volume resistivity of $10^{7.5}$ Ωcm or more and $10^{8.5}$ Ωcm or less, for example.

The backup roller 25 is disposed on the backside of the intermediate transfer belt 15 and serves as a counter electrode for the second transfer roller 22. A transfer electric field is formed between the backup roller 25 and the second transfer roller 22.

The backup roller 25 is provided by, for example, covering a rubber base member with a tube formed of a blend rubber material in which carbon is dispersed. The backup roller 25 has, for example, a surface resistivity of $10^7$ Ω/sq or more and $10^{10}$ Ω/sq or less and a hardness of 70° (Asker C, manufactured by KOBUNSHI KEIKI CO., LTD.; hereafter this is the same.)

A power supply roller 26 formed of metal is disposed so as to be in contact with the backup roller 25. The power supply roller 26 applies a voltage (second transfer bias) of a polarity the same as the polarity (negative polarity) of the charged toner. Thus, a transfer electric field is formed between the second transfer roller 22 and the backup roller 25.

An intermediate-transfer-belt cleaner 35 is disposed downstream of the second transfer part 20 of the intermediate transfer belt 15 such that the intermediate-transfer-belt cleaner 35 can be brought into contact with and separated from the intermediate transfer belt 15. The intermediate-transfer-belt cleaner 35 removes remaining toner and paper dust from the intermediate transfer belt 15 after the second transfer.

A reference sensor (home position sensor) 42 is disposed upstream of the image forming unit 1Y. The reference sensor 42 emits reference signals serving as a reference for adjusting image-forming timing in the image forming units. The reference sensor 42 detects a mark on the backside of the intermediate transfer belt 15 and emits reference signals. Upon detection of the reference signals, the controller 40 causes the image forming units 1Y, 1M, 1C, and 1K to start image forming.

An image density sensor 43 for adjusting image quality is disposed downstream of the image forming unit 1K.

The image forming apparatus 100 includes, as a transport system for transporting paper sheets K, a paper sheet tray 50, a paper feed roller 51, transport rollers 52, a transport guide 53, a transport belt 55, and a fixing entry guide 56.

The paper sheet tray 50 contains paper sheets K on which images are to be formed.

The paper feed roller 51 picks up a paper sheet K from the paper sheet tray 50.

The transport rollers 52 transport the paper sheet K having been picked up by the paper feed roller 51.

The transport guide 53 sends the paper sheet K having been transported by the transport rollers 52, to the second transfer part 20.

The transport belt 55 transports the paper sheet K onto which an image has been transferred in the second transfer part 20, to the fixing device 80.

The fixing entry guide 56 guides the paper sheet K to the fixing device 80.

Hereinafter, an image forming method using the image forming apparatus 100 will be described.

In the image forming apparatus 100, image data output from an image reading device (not shown), a computer (not shown), or the like is processed with an image processing device (not shown). The resultant data is used to form images by the image forming units 1Y, 1M, 1C, and 1K.

In the image processing device, the input reflectance data is subjected to image processing such as shading correction, misregistration correction, brightness/color space conversion, gamma correction, border removal, color edition, and transfer edition. The image data having been subjected to the image processing is converted into tone data corresponding to Y, M, C, and K four color materials, and output to the laser exposure devices 13.

The laser exposure devices 13 apply exposure beams Bm to the photoconductors 11 of the image forming units 1Y, 1M, 1C, and 1K in accordance with the input tone data corresponding to color materials.

The surfaces of the photoconductors 11 of the image forming units 1Y, 1M, 1C, and 1K are charged with the charging devices 12 and then subjected to scanning exposure with the laser exposure devices 13 to form electrostatic latent images. The electrostatic latent images formed on the photoconductors 11 are developed as toner images of the colors by the image forming units.

The toner images formed on the photoconductors 11 of the image forming units 1Y, 1M, 1C, and 1K are transferred onto the intermediate transfer belt 15, in the first transfer part 10 where the photoconductors 11 are in contact with the intermediate transfer belt 15. In the first transfer part 10, the first transfer rollers 16 apply a voltage (first transfer bias) of a polarity opposite to the polarity (negative polarity) of the charged toners, to the intermediate transfer belt 15. As a result, the toner images are sequentially transferred so as to be superposed on the intermediate transfer belt 15.

The toner image having been transferred by the first transfer onto the intermediate transfer belt 15 is transported to the second transfer part 20 by running of the intermediate transfer belt 15.

In correspondence with the timing when the toner image reaches the second transfer part 20, a paper sheet K contained in the paper sheet tray 50 is transported by the paper feed roller 51, the transport rollers 52, and the transport guide 53, fed to the second transfer part 20, and nipped between the intermediate transfer belt 15 and the second transfer roller 22.

In the second transfer part 20 in which a transfer electric field is formed, the toner image on the intermediate transfer belt 15 is electrostatically transferred (second transfer) onto the paper sheet K.

The paper sheet K onto which the toner image has been electrostatically transferred is released from the intermediate transfer belt 15 by the second transfer roller 22 and transported to the fixing device 80 by the transport belt 55.

The paper sheet K having been transported to the fixing device 80 is heated and pressed with the fixing device 80, so that the unfixed toner image is fixed.

Exemplary embodiments according to the present invention have been described so far. However, the present invention is not limited to these exemplary embodiments and various modifications, changes, and improvements can be made.

For example, in the above-described image forming apparatus, the toner images formed on the photoconductors are transferred by the first transfer onto the intermediate transfer belt and then transferred by the second transfer onto the recording medium. Alternatively, another image forming apparatus may be used in which the intermediate transfer body is not provided and toner images formed on the photoconductors are directly transferred onto a recording medium.

EXAMPLES

Hereinafter, examples will be described. However, the present invention is not limited to these examples.

Example 1

Production of Press Roller

Formation of Elastic Layer

An addition-reaction curable silicone rubber (manufactured by Shin-Etsu Chemical Co., Ltd., trade name: KE-1950-10) is uniformly mixed with Glass Bubbles K37 (manufactured by 3M Japan Limited) such that the content of the Glass Bubbles K37 is 25% by volume. The resultant substance is applied to the outer circumference of an aluminum core rod having a diameter of 22 mm by injection molding. Thus, an elastic layer having a thickness of 3.5 mm is formed and heat-cured at 150° C. for 30 minutes.

Formation of Thermal Conductive Layer

Subsequently, a thermal-conductive-layer coating solution is prepared by mixing, as a resin component, a polyimide precursor obtained from a diamine compound and tetracarboxylic acid dianhydride; as a scale-shaped filler, graphite having an average particle size of 5 μm and a thickness of 0.2 μm; and, as a solvent, NMP (N-methyl-2-pyrrolidone). The content of the scale-shaped filler relative to the entire solid content of the coating solution is set to 10% by volume.

This coating solution is applied to the outer circumference of the elastic layer by dip coating such that the resultant layer has a uniform thickness. Thus, a thermal-conductive-layer coating film is formed.

Formation of Surface Layer

Subsequently, the coating film is covered with a surface layer, a PFA (tetrafluoroethylene/perfluoroalkyl vinyl ether copolymer) tube (thickness: 50 μm). Curing is caused by heating at 200° C. for 60 minutes. Thus, a press roller having a width length of 320 mm is obtained.

The thermal conductive layer between the elastic layer and the surface layer has a thickness of 80 μm.

Examples 2 to 7

Press rollers are produced as in Example 1 except that, in the Formation of thermal conductive layer in Example 1, the type (material) and content of the scale-shaped filler are changed as described in Table 1.

In Examples 5 to 7, as the scale-shaped filler, boron nitride having an average particle size of 5 μm and a thickness of 0.2 μm is used.

Comparative Example 1

A press roller is produced as in Example 1 except that, in the Formation of thermal conductive layer in Example 1, the filler is changed to an acicular filler (manufactured by SHOWA DENKO K. K., trade name: carbon nanofibers VGCF, average length: 10 μm).

Comparative Example 2

A press roller is produced as in Example 1 except that, in the Formation of thermal conductive layer in Example 1, the filler is changed to a particulate filler (manufactured by Ube Material Industries, Ltd., trade name: magnesium oxide UC95, average particle size: 3 μm).

Evaluation

Each of the press rollers obtained in Examples and Comparative examples is attached to a fixing device for an image forming apparatus (DocuCentre C4475) manufactured by Fuji Xerox Co., Ltd. This fixing device is installed in the image forming apparatus.

A running test of printing an image on 100 sheets (J paper, A4SEF, manufactured by Fuji Xerox Co., Ltd.) is carried out with the image forming apparatus.

After the running test, the surface temperatures of the press roller are measured at a center portion (in paper-passing region) and at two end portions (in non-paper-passing region: each measurement position is separated from the corresponding end by 55 mm) in the width direction (shaft direction). The surface temperatures of the press roller are measured with an infrared thermometer IT2 (manufactured by Keyence Corporation). The temperatures at end portions are described as an average temperature of the temperatures at two end portions.

Table 1 summarizes the fillers of the thermal conductive layers and evaluation results.

TABLE 1

| | Filler in thermal conductive layer | | | Temperatures of press member after running test (° C.) | | |
|---|---|---|---|---|---|---|
| | Shape | Material | Content (vol %) | Center portion | End portions | Temperature difference |
| Example 1 | Scale-shaped | Graphite | 5 | 120 | 170 | 50 |
| Example 2 | Scale-shaped | Graphite | 10 | 120 | 155 | 35 |
| Example 3 | Scale-shaped | Graphite | 25 | 120 | 150 | 30 |
| Example 4 | Scale-shaped | Graphite | 50 | 120 | 140 | 20 |
| Example 5 | Scale-shaped | Boron nitride | 5 | 120 | 175 | 55 |
| Example 6 | Scale-shaped | Boron nitride | 25 | 120 | 155 | 35 |
| Example 7 | Scale-shaped | Boron nitride | 50 | 120 | 140 | 20 |
| Comparative example 1 | Acicular | Carbon nanofibers | 50 | 120 | 225 | 105 |
| Comparative example 2 | Particulate | Magnesium oxide | 50 | 120 | 265 | 145 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing press member comprising:

a substantially tubular thermal conductive layer containing a resin and a substantially scale-shaped filler having a higher thermal conductivity than the resin; and a surface layer disposed on an outer circumferential surface side of the thermal conductive layer.

2. The fixing press member according to claim 1, further comprising an elastic layer having a cellular structure and disposed on an inner circumferential surface side of the thermal conductive layer.

3. A fixing device comprising:

a fixing heating member that is rotatably disposed and comes into contact with one of surfaces of a recording medium, the one surface having an unfixed toner image;

a heating unit that heats the fixing heating member; and the fixing press member according to claim 2, the fixing press member being rotatably disposed such that the recording medium is nipped between the fixing press member and the fixing heating member and the fixing press member comes into contact with another one of the surfaces of the recording medium.

4. An image forming apparatus comprising:

an image carrier;

a charging unit that charges a surface of the image carrier;

a latent image forming unit that forms a latent image on a charged surface of the image carrier;

a developing unit that develops the latent image with toner to form a toner image;

a transfer unit that transfers the toner image onto a recording medium; and a fixing unit that includes the fixing device according to claim 3 and that fixes the toner image on the recording medium.

5. A fixing device comprising:

a fixing heating member that is rotatably disposed and comes into contact with one of surfaces of a recording medium, the one surface having an unfixed toner image;

a heating unit that heats the fixing heating member; and the fixing press member according to claim 1, the fixing press member being rotatably disposed such that the recording medium is nipped between the fixing press member and the fixing heating member and the fixing press member comes into contact with another one of the surfaces of the recording medium.

6. An image forming apparatus comprising:

an image carrier;

a charging unit that charges a surface of the image carrier;

a latent image forming unit that forms a latent image on a charged surface of the image carrier;

a developing unit that develops the latent image with toner to form a toner image;

a transfer unit that transfers the toner image onto a recording medium; and a fixing unit that includes the fixing device according to claim 5 and that fixes the toner image on the recording medium.

7. The fixing press member according to claim 1, wherein the scale-shaped filler comprises a plurality of scale-shaped pieces, each having a length X, a length Y in a direction perpendicular to the length X, and a thickness Z.

8. The fixing press member according to claim 7, wherein a ratio X/Y is greater than or equal to about 1 and less than or equal to about 5.

9. The fixing press member according to claim 8, wherein a ratio X/Z is greater than or equal to about 10 and less than or equal to about 500.

10. The fixing press member according to claim 7, wherein each of X and Y are greater than or equal to about 3 micrometers and less than or equal to about 10 micrometers, and Z is greater than or equal to about 0.01 micrometer and less than or equal to about 0.5 micrometer.

11. The fixing press member according to claim 1, wherein the fixing press member is a pressing roller or a pressing belt.

* * * * *